US009528714B2

(12) United States Patent
Tom

(10) Patent No.: US 9,528,714 B2
(45) **Date of Patent: *Dec. 27, 2016**

(54) 70 CFM BATH VENTILATION FANS WITH FLUSH MOUNT LIGHTS AND MOTOR BENEATH BLOWER WHEEL

(71) Applicant: Chin Luen Industries, Co., Ltd., Inc., Oakland Park, FL (US)

(72) Inventor: Lawrence Tom, Smryna, GA (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/930,087

(22) Filed: Nov. 2, 2015

(65) Prior Publication Data

US 2016/0054015 A1 Feb. 25, 2016

Related U.S. Application Data

(62) Division of application No. 13/042,992, filed on Mar. 8, 2011, now Pat. No. 9,175,874.

(60) Provisional application No. 61/381,605, filed on Sep. 10, 2010.

(51) Int. Cl.

| | |
|---|---|
| ***A62C 2/12*** | (2006.01) |
| ***F21V 33/00*** | (2006.01) |
| ***F24F 7/007*** | (2006.01) |
| ***F24F 13/06*** | (2006.01) |
| ***F04D 19/00*** | (2006.01) |
| ***F24F 13/078*** | (2006.01) |
| *F21Y 113/00* | (2016.01) |

(52) U.S. Cl.

CPC ..... *F24F 7/007* (2013.01); *F04D 19/00* (2013.01); *F21V 33/0088* (2013.01); *F21V 33/0096* (2013.01); *F24F 13/06* (2013.01); *F24F 13/078* (2013.01); *F21Y 2113/00* (2013.01)

(58) Field of Classification Search

USPC ..... 454/349
IPC ..... F24F 7/007,13/06; F04D 19/00
See application file for complete search history.

(56) References Cited

U.S. PATENT DOCUMENTS

| | | | |
|---|---|---|---|
| 1,823,479 | A | 9/1931 | Venderbush |
| 2,519,503 | A | 8/1950 | Rigaumont |
| 2,689,906 | A | 9/1954 | Corbett |
| 2,697,163 | A | 12/1954 | Spear |
| 2,950,859 | A | 8/1960 | Kirk |
| 3,065,686 | A | 11/1962 | Geocaris |
| 3,068,341 | A | 12/1962 | Ortiz |

(Continued)

OTHER PUBLICATIONS

Tom, Lawrence, Office Action Summary mailed Nov. 7, 2014 for U.S. Appl. No. 13/289,312, filed Nov. 4, 2011, 14 pages.

(Continued)

*Primary Examiner* — Helena Kosanovic
(74) *Attorney, Agent, or Firm* — Brian S. Steinberger; Law Offices of Brian S. Steinberger, P.A.

(57) ABSTRACT

Apparatus, systems and methods of generating 70 (seventy) CFM (cubic feet per minute) from ventilation fans for bathrooms with flush mount lights and having the motor partially inside and beneath the blower wheel. A one piece or multipiece housing for the bath fan can be attached to joists in the ceiling by a long telescoping mounting bracket, and a short telescoping mounting bracket that are each directly mounted on opposite outer side walls of the housing. A decorative pan about the light can have vents that receive the incoming air into the fan, which is exhausted therefrom by the motor driven blower.

17 Claims, 13 Drawing Sheets

(56) References Cited

U.S. PATENT DOCUMENTS

| | | | |
|---|---|---|---|
| 3,125,943 | A | 3/1964 | Geocaris |
| 3,223,019 | A | 12/1965 | Schuh |
| 3,227,063 | A | 1/1966 | Lambert |
| 3,246,137 | A | 4/1966 | Zagel |
| 3,306,179 | A | 2/1967 | Lambie et al. |
| 3,665,838 | A | 5/1972 | Shepherd |
| 3,785,271 | A | 1/1974 | Joy |
| 3,796,249 | A | 3/1974 | McCabe |
| 4,510,851 | A | 4/1985 | Sarnosky |
| 4,526,318 | A | 7/1985 | Fleming |
| 4,537,117 | A | 8/1985 | Cavestany |
| 4,589,476 | A | 5/1986 | Berner |
| 4,616,696 | A | 10/1986 | Brundrett et al. |
| 4,657,291 | A | 4/1987 | Kurosaki |
| 4,681,024 | A | 7/1987 | Ivey |
| 4,726,559 | A | 2/1988 | Hultmark |
| 4,798,518 | A | 1/1989 | Holzberger et al. |
| 4,867,640 | A | 9/1989 | Penlesky |
| 4,954,049 | A | 9/1990 | Armbruster |
| 5,232,152 | A | 8/1993 | Tsang |
| 5,567,200 | A | 10/1996 | Swartzendruber |
| 5,620,370 | A | 4/1997 | Umai |
| 5,934,783 | A | 8/1999 | Yoshikawa |
| 6,161,175 | A | 12/2000 | Kim |
| 6,215,885 | B1 | 4/2001 | Geiger |
| 6,261,175 | B1 | 7/2001 | Larson |
| 6,329,908 | B1 | 12/2001 | Frecska |
| 6,340,237 | B1 | 1/2002 | Koga |
| D457,232 | S | 5/2002 | Miura |
| D457,616 | S | 5/2002 | Yamanaka |
| 6,384,352 | B1 | 5/2002 | Ellman et al. |
| 6,488,579 | B2 | 12/2002 | Larson |
| 6,538,881 | B1 | 3/2003 | Jeakins |
| 6,632,006 | B1 | 10/2003 | Rippel |
| 6,802,770 | B2 | 10/2004 | Larson |
| 6,897,580 | B2 | 5/2005 | White |
| 6,979,169 | B2 | 12/2005 | Penlesky |
| D521,145 | S | 5/2006 | Craw |
| 7,055,582 | B2 | 6/2006 | Erisgen |
| 7,128,303 | B2 | 10/2006 | Penlesky |
| D535,433 | S | 1/2007 | Craw |
| 7,175,309 | B2 | 2/2007 | Craw |
| 7,203,416 | B2 | 4/2007 | Craw |
| D565,716 | S | 4/2008 | Jacak |
| D575,387 | S | 8/2008 | Zakula |
| D577,805 | S | 9/2008 | Adrian |
| D581,508 | S | 11/2008 | Miyake |
| 7,455,432 | B2 | 11/2008 | Craw |
| 7,455,500 | B2 | 11/2008 | Penlesky |
| 7,481,559 | B1 | 1/2009 | Rashidi |
| 7,591,867 | B2 | 9/2009 | Choi |
| 7,606,379 | B2 | 10/2009 | Ivey et al. |
| 7,654,495 | B2 | 2/2010 | Adrian |
| 7,677,964 | B1 | 3/2010 | Bucher |
| 7,845,803 | B2 | 12/2010 | Lv |
| 7,881,827 | B2 | 2/2011 | Park et al. |
| 7,922,335 | B2 | 4/2011 | Sakai |
| 7,993,037 | B1 | 8/2011 | Buse |
| D653,323 | S | 1/2012 | Jacak |
| 8,104,502 | B2 | 1/2012 | Nakata |
| D654,998 | S | 2/2012 | Zakula |
| 8,113,148 | B2 | 2/2012 | Chem |
| 8,172,655 | B2 | 5/2012 | Liu |
| 8,218,805 | B2 | 7/2012 | Hornback |
| 8,295,504 | B2 | 10/2012 | Ady et al. |
| D681,249 | S | 4/2013 | Tom |
| 8,485,696 | B2 | 7/2013 | Pringle et al. |
| 8,591,037 | B2 | 11/2013 | Nagumo |
| 8,961,126 | B1 | 2/2015 | Tom |
| 9,022,846 | B1 | 5/2015 | Tom |
| 9,028,212 | B1 | 5/2015 | Tom |
| 9,097,265 | B1 | 8/2015 | Tom |
| 9,103,104 | B1 | 8/2015 | Tom |
| 9,175,874 | B1 | 11/2015 | Tom |
| 9,188,132 | B1 | 11/2015 | Tom |
| 9,416,985 | B2 | 8/2016 | Tom |
| 9,416,989 | B1 | 8/2016 | Tom |
| 2003/0133815 | A1 | 7/2003 | Grant |
| 2005/0006549 | A1 | 1/2005 | Liu |
| 2005/0111972 | A1 | 5/2005 | Penlesky |
| 2006/0172693 | A1 | 8/2006 | Lundquist |
| 2006/0199515 | A1 | 9/2006 | Lasko |
| 2007/0131827 | A1 | 6/2007 | Nevers |
| 2008/0261508 | A1 | 10/2008 | Deng |
| 2008/0318515 | A1 | 12/2008 | Yeung |
| 2009/0028372 | A1 | 1/2009 | Cerasuolo |
| 2009/0073702 | A1 | 3/2009 | Craw |
| 2009/0116189 | A1 | 5/2009 | Chang |
| 2009/0170421 | A1 | 7/2009 | Adrian |
| 2010/0009621 | A1 | 1/2010 | Hsieh |
| 2010/0112927 | A1 | 5/2010 | Marga |
| 2010/0171681 | A1 | 7/2010 | Cabanas et al. |
| 2010/0226139 | A1 | 9/2010 | Lynch |
| 2012/0250335 | A1 | 10/2012 | Nakano |
| 2012/0274767 | A1 | 11/2012 | Hornback |
| 2013/0084793 | A1 | 4/2013 | Yang et al. |
| 2013/0114826 | A1 | 5/2013 | Chang |
| 2014/0177900 | A1 | 6/2014 | Berkman |

OTHER PUBLICATIONS

Tom, Lawrence, Listing of pending claims for U.S. Appl. No. 13/289,312, filed Nov. 4, 2011, 7 pages.

Tom, Lawrence, Office Action Summary mailed Oct. 22, 2014 for U.S. Appl. No. 13/042,992, filed Mar. 8, 2011, 16 pages.

Tom, Lawrence, Listing of pending claims for U.S. Appl. No. 13/042,992 filed Mar. 8, 2011, 7 pages.

Tom, Lawrence, Office Action mailed Jan. 8, 2015 for U.S. Appl. No. 13/233,700, filed Sep. 15, 2011, 25 pages.

Tom, Lawrence, Amendment Response filed Oct. 3, 2014 for U.S. Appl. No. 13/233,700 filed Sep. 15, 2011, 13 pages.

70 CFM BATH VENTILATION FANS WITH FLUSH MOUNT LIGHTS AND MOTOR BENEATH BLOWER WHEEL

This application is a Continuation patent application of U.S. patent application Ser. No. 13/042,992 filed Mar. 8, 2011, now U.S. Pat. No. 9,175,874, which claims the benefit of priority to U.S. Provisional Patent Application Ser. No. 61/381,605 filed Sep. 10, 2010. The entire disclosure of each of the applications listed in this paragraph are incorporated herein by specific reference thereto.

FIELD OF USE

This invention relates to ventilation exhaust fans, and in particular to apparatus, devices, systems and methods of 70 CFM ventilation fans for bathrooms with flush mount lights and having the motor underneath the blower wheel.

BACKGROUND AND PRIOR ART

Various types of bathroom ventilation fans have been proposed and used over the years. See for example, U.S. Pat. No. 4,867,640 to Penlesky et al.; U.S. Pat. No. 4,510,851 to Sarnosky et al.; U.S. Pat. No. 6,261,175 to Larson et al.; U.S. Pat. No. 6,488,579 to Larson et al.; U.S. Pat. No. 6,802,770 to Larson et al.; U.S. Pat. No. 7,203,416 to Craw et al.; and U.S. Pat. No. 7,654,495 to Adrian et al.

There have been many problems with the prior art. For example, many bathfans are difficult to be installed into a ceiling since the housings can not be easily attached to different locations of joists in the ceiling. If a joist is off center to the middle of bathroom ceiling the bath fan is not easy to center in the room. Additionally, many of the bath fans have numerous parts which add extra manufacturing costs. And as a result a bath fan that requires assembly of the bath fan at a job site will incur undesirable extra labor and material costs to install. Additionally, many bath fans have to be wired to components inside of the housings which also requires extra expensive labor costs to make the connections onside during the installation of the bath fan.

Thus, the need exists for solutions to the above problems with the prior art.

SUMMARY OF THE INVENTION

A primary objective of the present invention is to provide ventilation fans, apparatus, devices, systems and methods for bathrooms with flush mount lights with a motor beneath the blower wheel that provides 70 (seventy) CFM (cubic feet of air per minute) in ventilation.

A secondary objective of the present invention is to provide ventilation fans, apparatus, devices, systems and methods for bathrooms with flush mount light shade having an exterior rim with at least one opening for passing air to a blower inside a housing where the air does not pass into a shade and on light sources under the shade.

A third objective of the present invention is to provide ventilation fans, apparatus, devices, systems and methods for bathrooms with flush mount lights, having a one piece plate with side opening around a blower fan so that the incoming air is guided around blower fan and out the side opening and out the side exhaust opening of a housing, in order to reduce excess noise from air movement.

A fourth objective of the present invention is to provide ventilation fans, apparatus, devices, systems and methods for bathrooms with flush mount light, with telescoping leg(s) on an outer wall of a housing for attaching the housing to joists within a ceiling.

An embodiment of the bathroom ventilation exhaust fan, can include a one-piece housing having closed top, side walls and open bottom, a blower wheel inside of the housing, a motor partially inside of and beneath the blower wheel, and a flush mount light attached to the bottom of the housing.

The motor can be an approximately 70 (seventy) CFM (cubic feet per minute) generating motor.

The housing can include a first elongated side telescoping bracket directly mounted along one side wall of the housing, and a second elongated side telescoping bracket directly mounted along an opposite side wall of the housing, the second elongated side telescoping bracket being shorter than the first elongated side telescoping bracket.

The flush mount light can include a dome shaped shade.

The housing can further include a rod that connects the blower wheel to the motor, and a nut generally in the center of the wheel that fastens to the rod so that when the motor is on, the motor causes the blower wheel to spin.

The housing can further include a decorative pan having vents about the light, wherein air enters through the vents into the exhaust fan.

The exhaust fan can be used as a bath fan.

Another embodiment of the ventilation exhaust fan, can include a one-piece housing having closed top, side walls and open bottom, a blower wheel inside of the housing, a motor partially inside of and beneath the blower wheel, a light attached to the bottom of the housing, and a pan having vents about the light, wherein air enters through the vents into the exhaust fan and is exhausted therefrom by the motor run blower.

A method of ventilating air from a space through a ceiling mounted fan with light, can include the steps of locating a blower wheel and motor in a housing with at least a portion of the motor located outside of the blower wheel, the housing having an side exhaust opening, mounting the housing within a ceiling, mounting a light shade with an inside source having an exterior rim with at least one opening, to the box, with the rim and light shade below the ceiling, and passing incoming air through the at least one opening of the rim and into the middle of the blower wheel and out the side exhaust opening, so that the incoming air does not pass into the light shade and around the light source;

The least one opening in the rim can include a plurality of slotted vent openings.

The method can further include the step of positioning a one piece plate having one side opening around the blower wheel so that the incoming air is guided around blower wheel and out the side opening and out the side exhaust opening of the housing, in order to reduce excess noise from air movement.

The method can further include at least one telescoping leg attached to an exterior wall of the housing, for attaching the housing to a joist inside of the ceiling. The at least one telescoping leg can also include a first telescoping leg on one exterior side of the housing, and a second telescoping leg on an opposite exterior side of the housing, the first and the second telescoping legs for attaching the housing to joists inside of the ceiling.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

This invention claims the benefit of priority to U.S. Provisional Patent Application Ser. No. 61/381,605 filed Sep. 10, 2010, which is incorporated by reference.

A list of the components for FIGS. 1-11 will now be described.

Figure 1A:
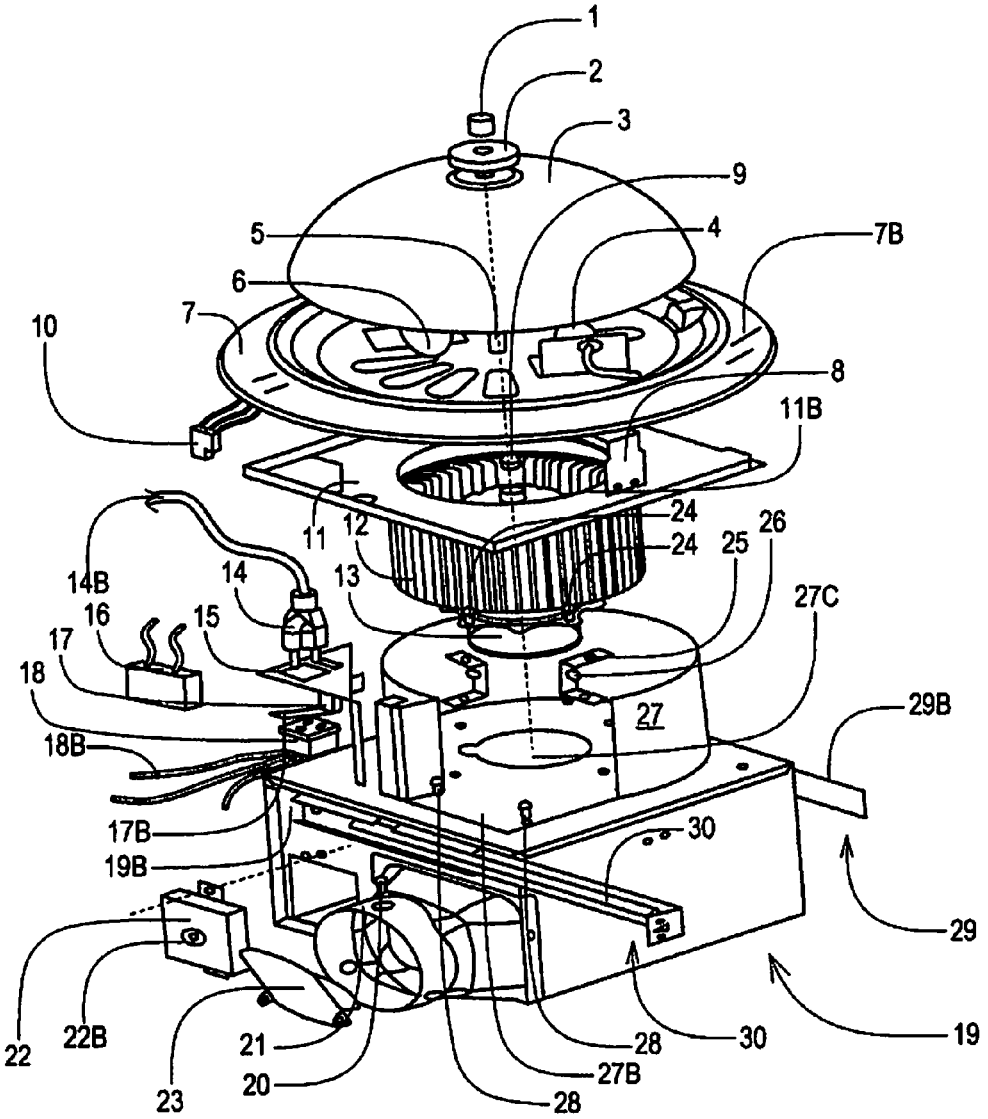
FIG. 1A is an exploded view of a 70 CFM bath fan (with no heater) with flush mount light and a motor located beneath the blower wheel.
Figure 1B:
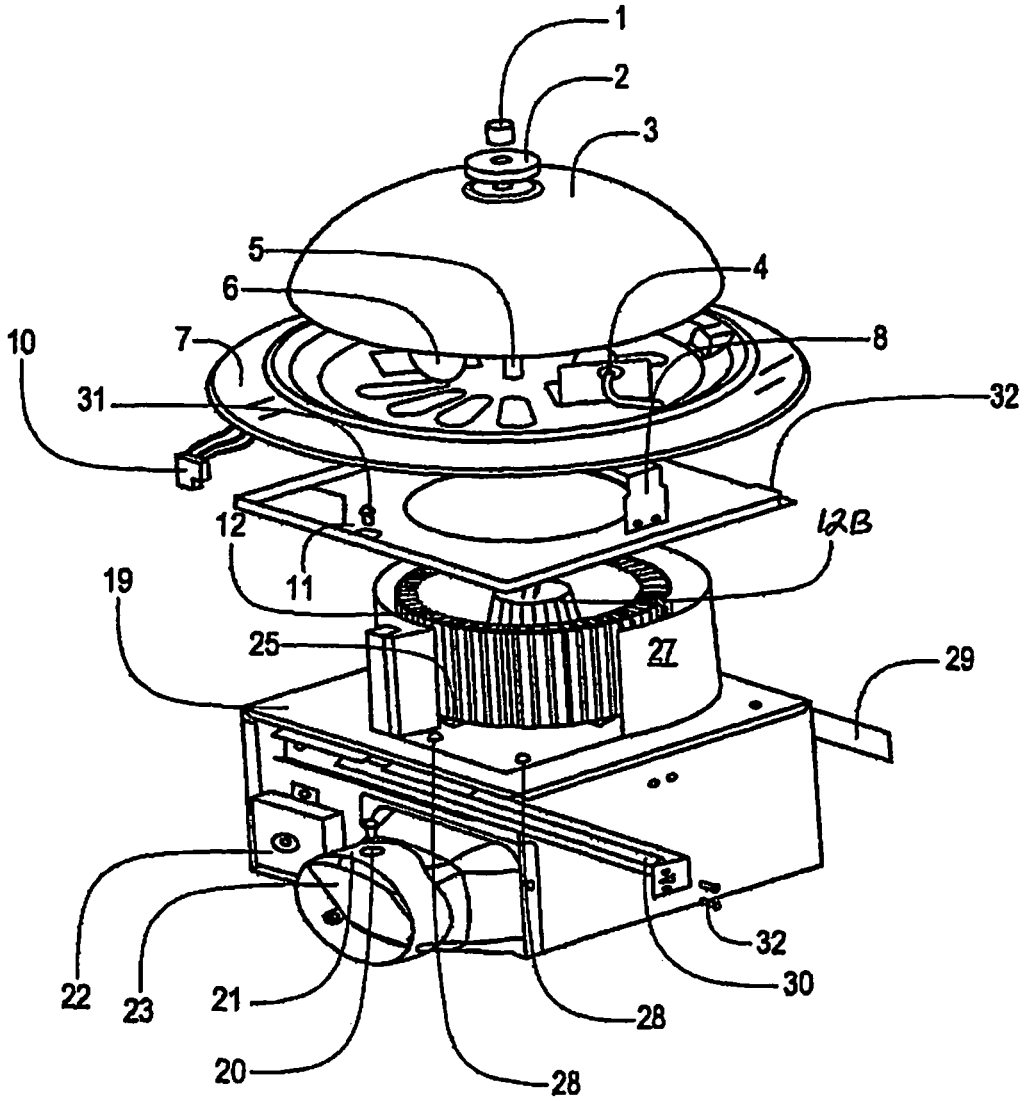
FIG. 1B is another exploded view the bath fan of FIG. 1, with some attached components.
Figure 2A:
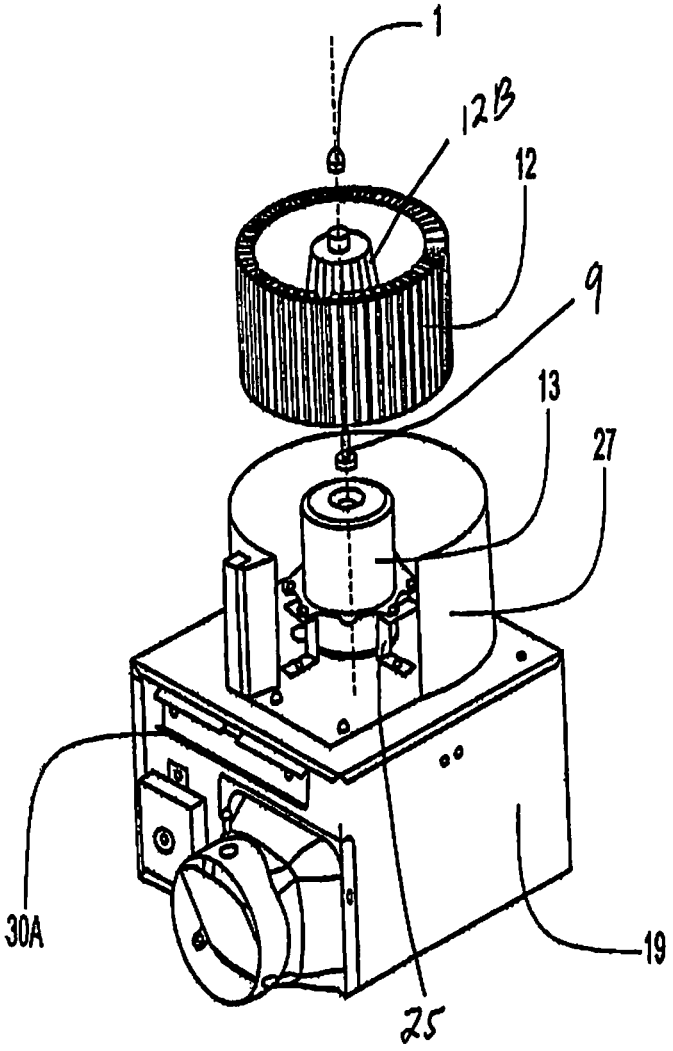
FIG. 2A is a partial exploded view of the bath fan of FIGS. 1A-1B showing blower wheel and motor and blower housing detached from the housing.
Figure 2B:
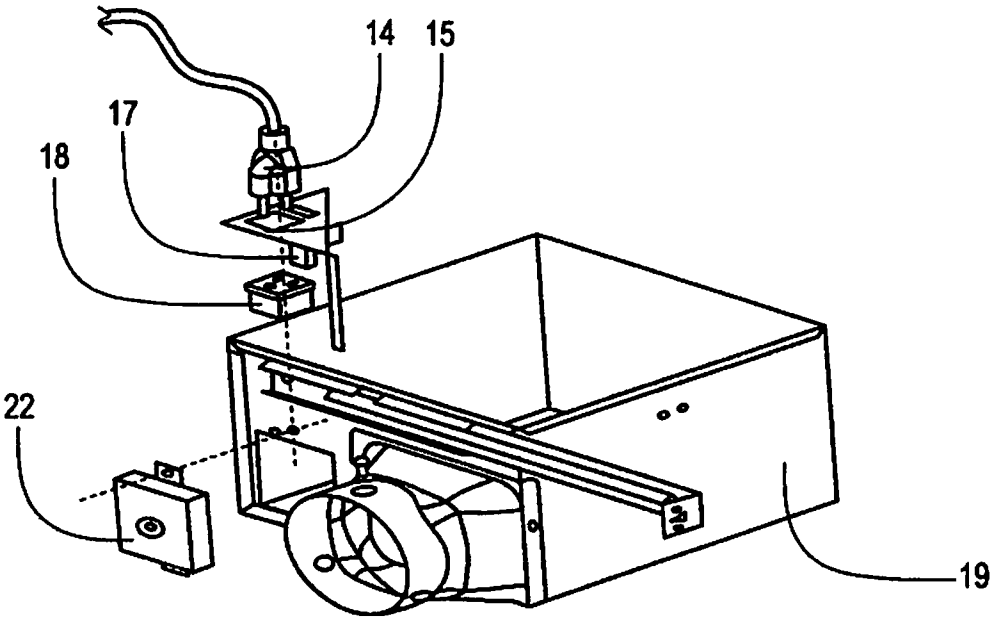
FIG. 2B is a partial exploded view of the bath fan of FIGS. 1A, 1B, and 2A with plug components and wiring box cover detached from the housing.

1. Decorative Nut.
2. Decorative Cover.
3. Glass Shade/Light
4. Socket(2)
5. Connect Screw
6. Bulb(2)
7. Grille Rim
7B. slotted openings
8. Grill bracket
8B. Flange edges
9. M8 Tower Form
10. Plug 3-Pin
11. Cover Plate
11B. Central opening
12. Impeller(Blower wheel)
13. Electric Motor
14. Plug 2-Pin
14B. wire leads to plug 14
15. Insert Plate
16. Capacitor
17. Plug 3-Pin
18. Female socket for Plug 2-Pin
19. Housing
19B. Fourth sidewall
20. Damper Connect Screw
21. Outlet duct
22. Wiring Box Cover
23. Damper
24. M5X12 Screw(4)
25. Motor Bracket(4)
26. Fasteners (M5 Screw Nut(4))
27. blower housing
27B. bottom plate of blower housing
27C. central opening
28. M4X10 Screw(4)
29. Short Suspension Bracket(2 part)
29A base pre-attached to exterior sidewall of housing
29B short slidable member
30. Long Suspension Bracket (2 part)
30A base pre-attached to exterior sidewall of housing
30B long slidable member
31. screw
32. tabs
33. joist FIG. 1A is an exploded view of a 70 CFM bath fan (with no heater) with flush mount light 3 and a motor 13 located beneath the blower wheel 12. FIG. 1B is another exploded view the bath fan of FIG. 1, with some attached components. FIG. 2A is a partial exploded view of the bath fan of FIGS. 1A-1B showing blower wheel 12 and motor 13 and blower wheel 12 detached from the housing 19. FIG. 2B is a partial exploded view of the bath fan of FIGS. 1A, 1B, and 2A with plug components and wiring box cover detached from the housing 19.

Referring to FIGS. 1A, 1B, 2A, and 2B, the novel bath fan is shown in exploded views where the ceiling mounted light (glass shade) 3 is shown above the housing 19 in order to more clearly show the various components of the bath fan. In operation, the orientation of the housing is on top of the ceiling mounted light (glass shade) 3, which is shown and described later in reference to FIG. 10.

A generally box shaped main housing 19 can be formed from one piece of bent metal that forms three sidewalls with an open top and bottom. A fourth sidewall 19B can be attached to the open side of the housing 19. The fourth sidewall 19B can have an outlet duct 21 with inwardly narrowing walls and generally cylindrical outlet end with a pivotally attached spring loaded damper door 23 that is held in place to the duct 21 by a damper connect screw 20. The outlet duct 21 can feed into an exhaust line in the ceiling to exhaust air from the room below. A rectangular opening in the fourth sidewall 19B can be an exterior wiring box cover 20 having outer flanges that can be mounted to the fourth sidewall 19B by conventional fasteners (not shown), such as screws, and the like.

Figure 3:
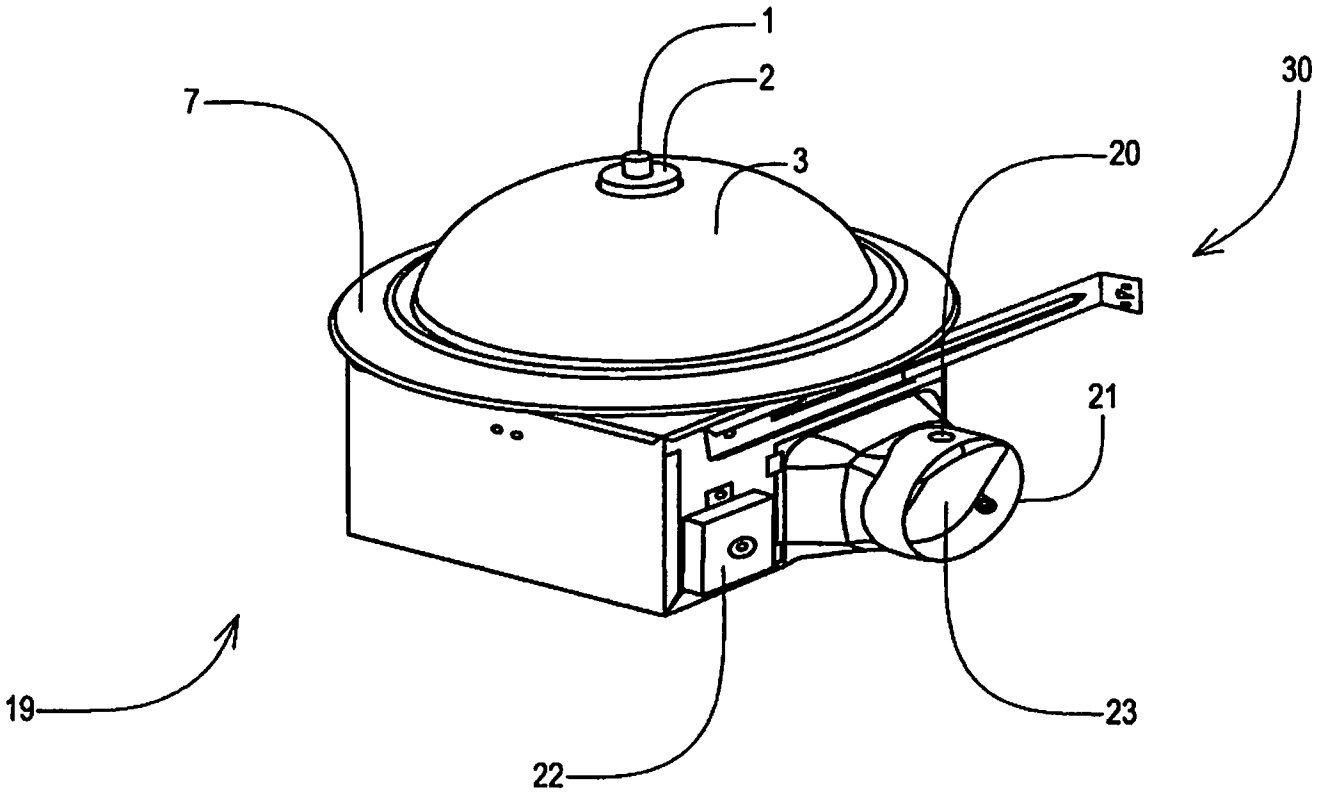
FIG. 3 is a perspective bottom front right side view of the assembled bath fan of FIG. 1 showing the damper and wiring box cover.
Figure 4:
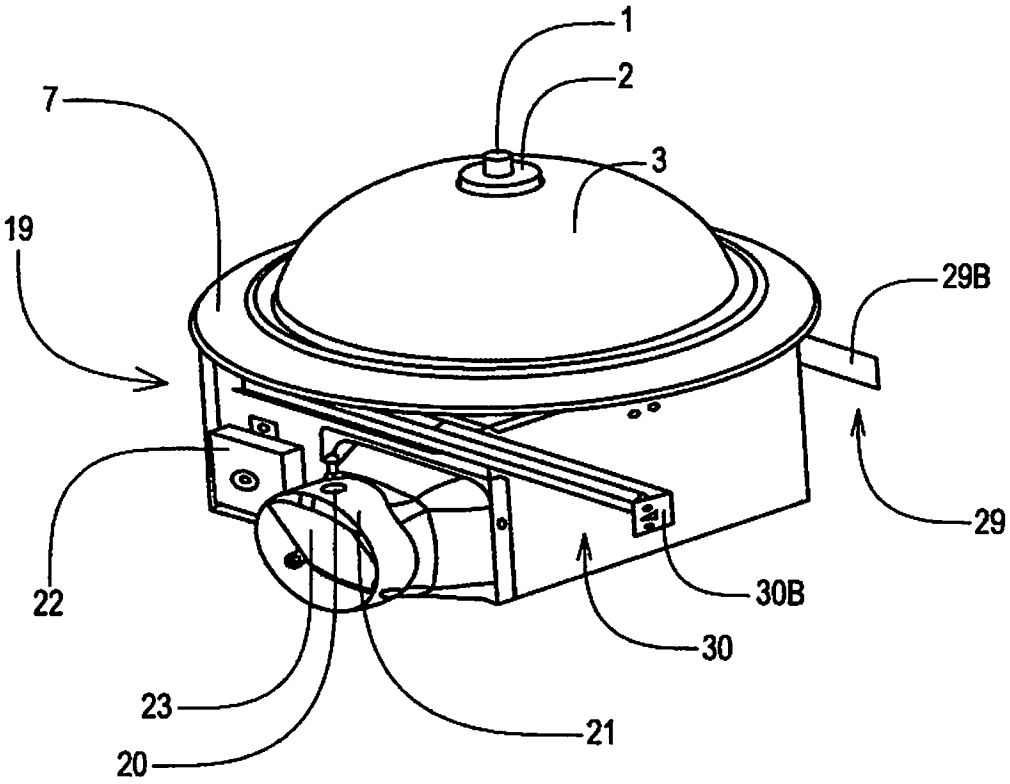
FIG. 4 is a perspective bottom front left side view of the assembled bath fan of FIG. 3 showing the damper and wiring box cover.

FIG. 3 is a perspective bottom front right side view of the assembled bath fan of FIG. 1 showing the damper 23 in the duct outlet 21 and wiring box cover 22 on the side of the housing 19. FIG. 4 is another perspective bottom front left side view of the assembled bath fan of FIG. 3 showing the damper 23 and wiring box cover 22 on the side of the housing 19.

Figure 5:
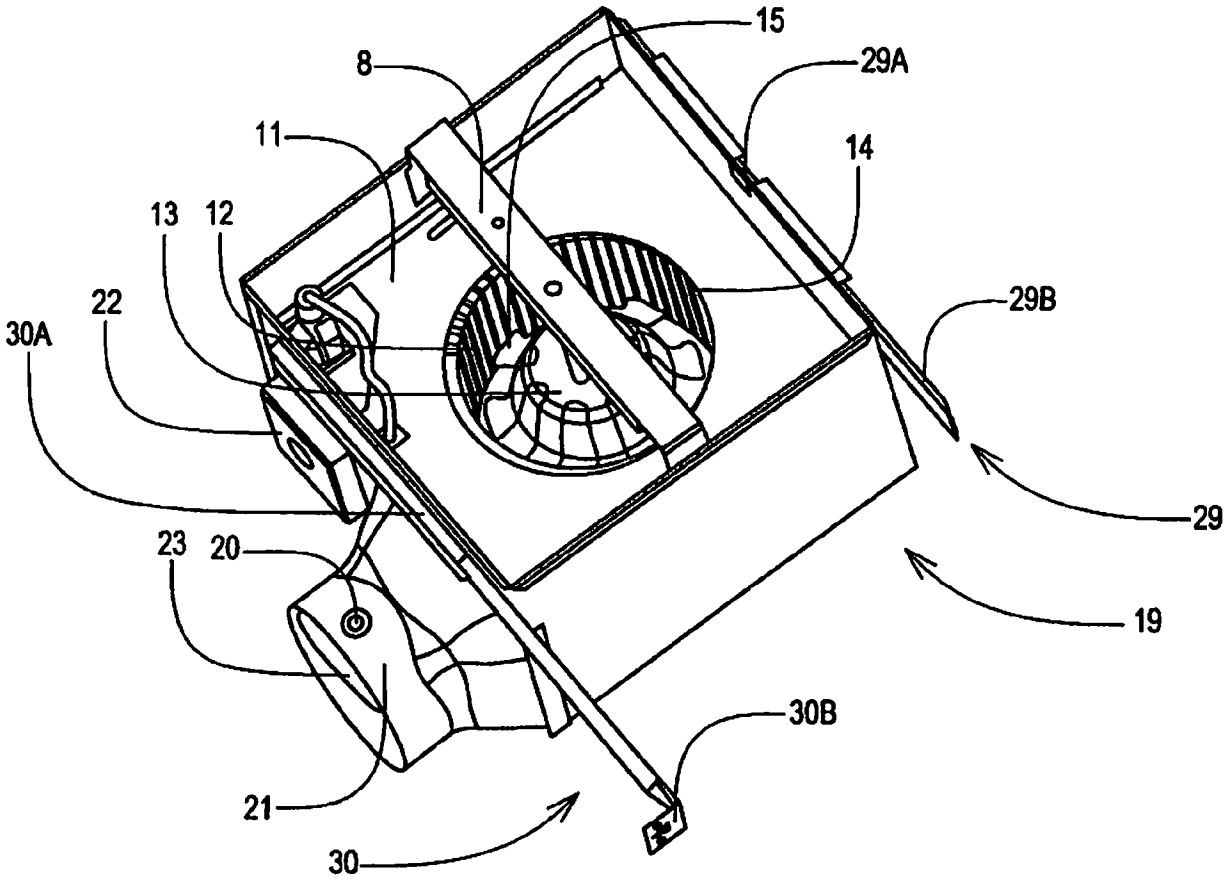
FIG. 5 is a perspective top front right side view of the assembled bath fan of FIG. 3 showing the damper and wiring box cover.

FIG. 5 is another perspective top front right side view of the assembled bath fan of FIG. 3 showing the damper 23 and wiring box cover 22 on the side of the housing 19.

Figure 6:
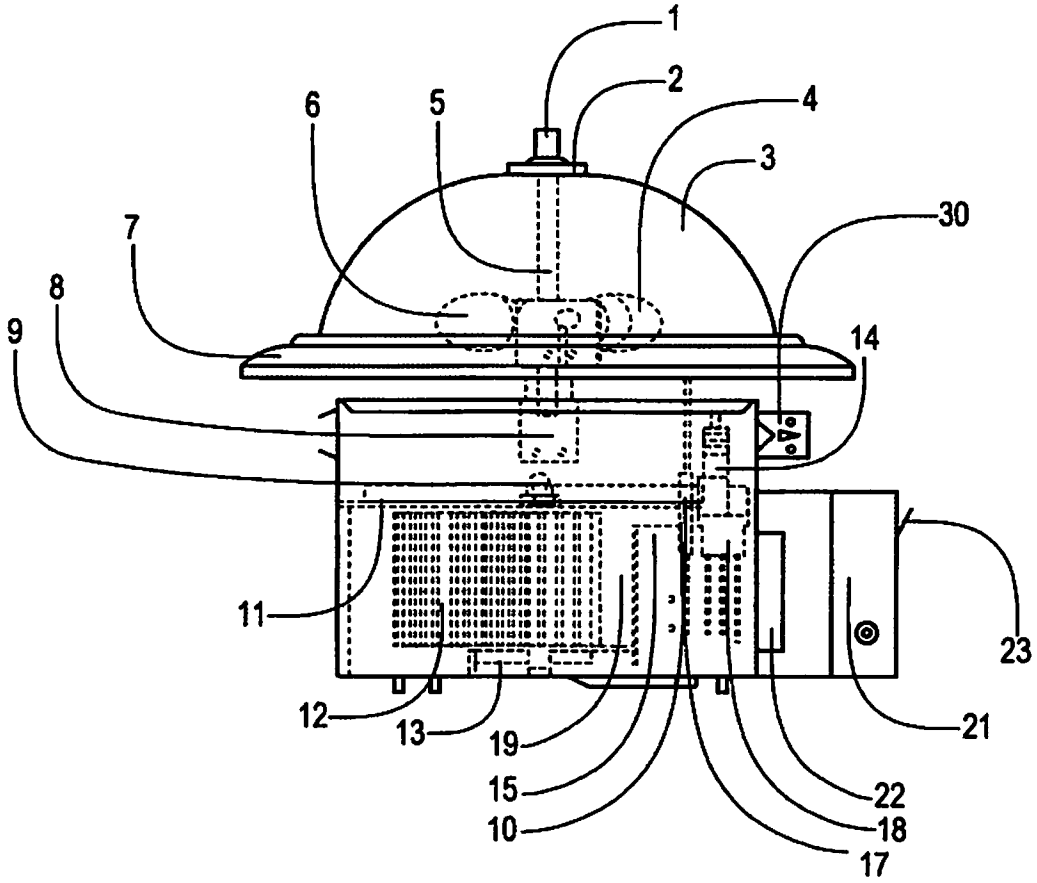
FIG. 6 is a left side view of the assembled bath fan of FIG. 3 showing the damper and wiring box cover.

FIG. 6 is a left side view of the assembled bath fan of FIG. 3 showing the damper and wiring box cover.

Figure 7:
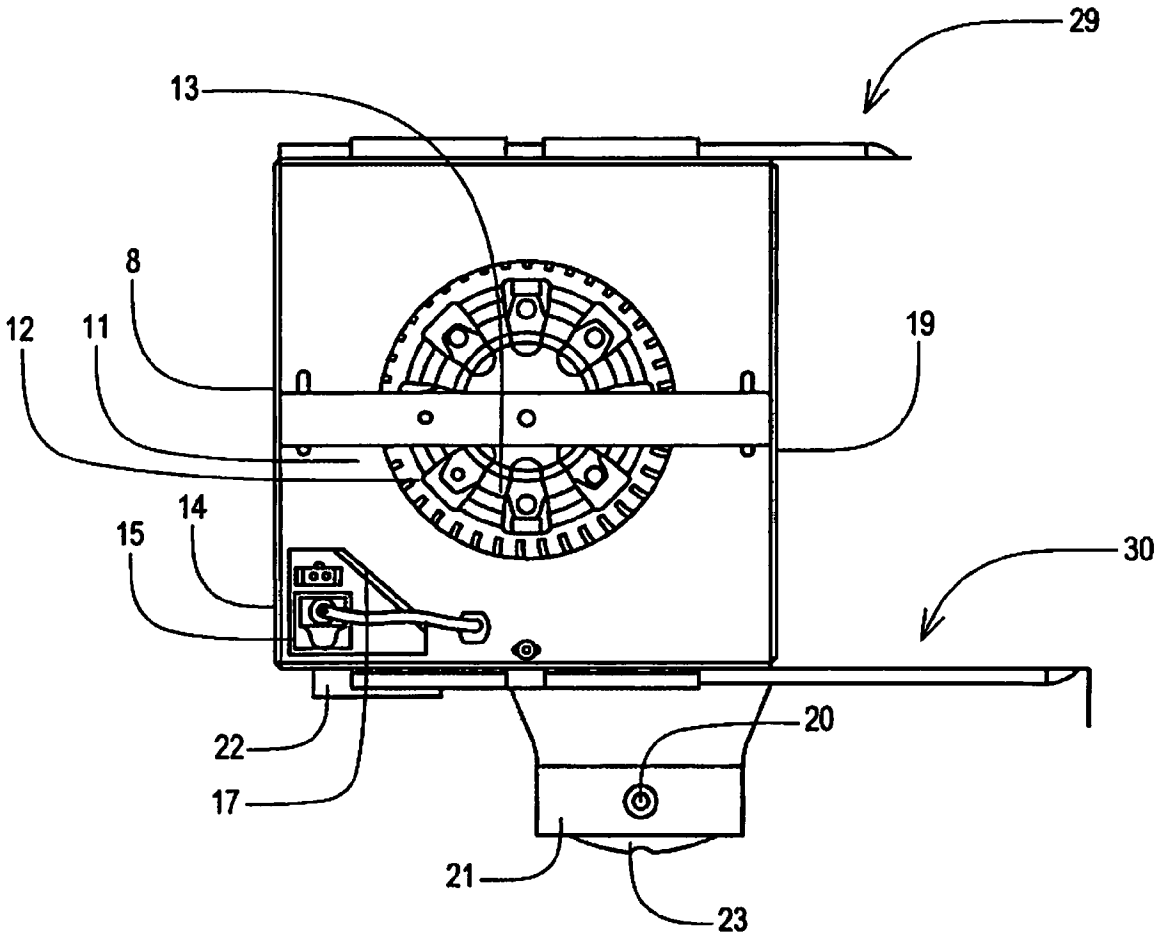
FIG. 7 is a top view of the assembled bath fan of FIG. 3 showing the damper and wiring box cover.

FIG. 7 is a top view of the assembled bath fan of FIG. 3 showing the damper and wiring box cover.

Figure 8:
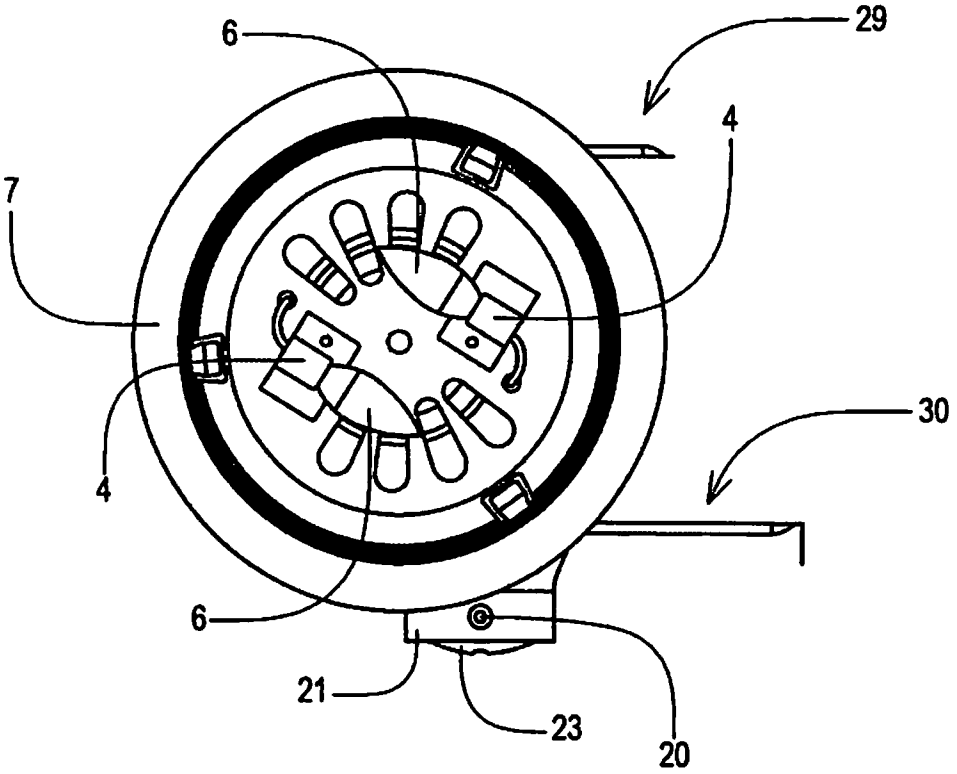
FIG. 8 is a bottom view of the assembled bath fan of FIG. 3 without the light cover showing the sockets and bulbs.

FIG. 8 is a bottom view of the assembled bath fan of FIG. 3 without the light cover 3 showing the sockets 4 and bulbs 6.

Figure 9:
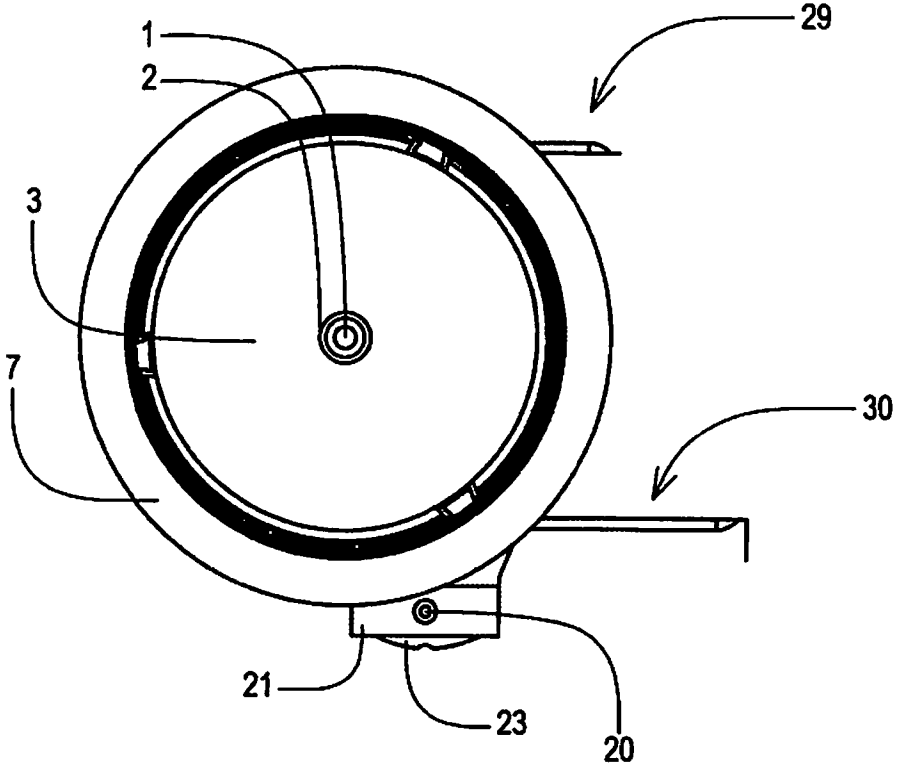
FIG. 9 is a bottom view of the assembled bath fan of FIG. 3 with the light cover.

FIG. 9 is a bottom view of the assembled bath fan of FIG. 3 with the light cover 3.

As shown in FIGS. 1A and 2B and 3-9, an installer can connect external electrical power to wire leads 17B and 18B that can pass through a central opening 22B in the wiring box cover 22. The wire leads 17B, 18B can be preformed to run into the housing 19 through wiring box cover 22 to the female three socket 18 (which can power the motor 13) and to the second female socket 17 (which can power the bulbs 6 in sockets 2). A triangular insert plate 15 can have openings that allow the female sockets 17, 18 to be mounted therein, wherein the insert plug plate 15 can have side and lower extending flanges so that the plate 15 can be fixably pre-attached to an inner corner of two sidewalls of the housing 19 by conventional fasteners (not shown) such as screws, and the like, or welded in place.

Mounted along opposite exterior sides of the housing 19 can be extendable two part extension brackets 29 and 30. Each of the extension brackets can have respective base members 29A, 30A pre-attached by fasteners or by welding to respective opposite exterior sidewalls of the housing 19 and a telescopingly slidable members 29B, 30B that can slide in and out of the respective base members 29A, 29B. The outer ends of the slidable members 29B, 30B can be bent at approximately 90 degrees so as to attach to joists in ceiling. One of the extension brackets 29 can have an slidable member 29B that is shorter in length than the opposite slidable member 30B on the opposite extension bracket 30.

Alternatively, the shorter bracket 29 can be used on the same wall as the outlet 21, and the longer bracket 20 can be located on the opposite exterior sidewall. Alternatively, slidable extension brackets of equal length can be located on opposite exterior sidewalls of the housing 19. Still furthermore, the invention can be practiced with one exterior mounted slidable extension bracket. Still furthermore, three, four or more exterior mounted slidable extension brackets mounted to the housing can be used as needed.

A blower housing (scroll type housing) 27 having a generally cylindrical upper walls and side opening and open top with a generally flat bottom plate can be mounted into the main housing 19 by fasteners 28, such as screws, bolts, and the like. The side opening in the blower housing 27 is lined up with the exhaust outlet 21. The bottom plate 27B of the blower housing 27 can close off the bottom opening in the main housing 19. Fasteners 28, such as screws and bolts, can attach the base plate of the blower housing 27 to inwardly bent lower edges (not shown) on sidewalls of the main housing 19. The blower housing 27 can be formed from a one-piece metal plate 28 that surrounds the blower wheel 12 and helps guide the air towards the outlet duct 21 which reduces excess noise from air movement.

A motor 13 can have four brackets 25 extending therebelow. Each of the brackets 25 can include two L-shaped flanges that can be fastened to each other by fasteners 26, such as screws/bolts and nuts. The lower flange of each of the brackets 25 can be L-shaped so as to be attached to respective openings in the bottom plate 27B of the blower housing 27 by conventional fasteners (not shown) such as screws, bolts, and the like. The upper L-shaped flange of each of the brackets 25 can have a shorter outwardly extending edge than the lower L-shaped flanges, so that the bottom of the impeller (blower wheel) 12 can sit on the lower L-shaped flange exterior protruding edge, and the upper shorter L-shaped flange is inside the impeller (blower wheel) 12. The motor 13 can connected to an electrical cord 14B that can be attached to a three prong plug 14 which can be removably attached to the mounted female socket 18 in the plug plate 15.

Referring to FIGS. 1A, 1B, and 6, the motor 13 is shown partially inside and outside (beneath) the blower wheel (impeller) 12

The screws 24 (FIG. 1A) are to mount the motor 13 to the bottom plate 27B of the housing 27. This prevents the motor 13 from shifting and vibrating since it secures the motor 13. The circular opening 27C at the bottom of 27 is where the motor 13 sits. The capacitor 16 (FIG. 1A) can be attached to the housing 19 with double sided tape and can be attached a an inner side of a front panel of the housing 19.

A cover plate 11 having a central opening 11B can close off the upper opening in the housing 19. The inside of the rotatable blower wheel 12 has a dome shape 12B with opening, that fits over a tower form 9 having a threaded outer end, wherein the tower form 9 is rotated by the motor 13.

A disc shaped bracket 8 with outer grill rim 7, houses two sockets 4 with respective bulbs 6. The grill rim 7 can have slotted openings there through which allow incoming air from the room below the ceiling mounted bath fan to enter into the housing 19. Incoming air passes through slotted openings of the rim 7 and into the middle of the blower wheel 12 and out the exhaust duct 21 The air enters through the openings of the flush mount plate 7 into the blower wheel and then the blower wheel guides the air around the metal plate 28 towards the outlet duct 21 finally to be exhausted.

The disc shaped bracket 8 has a connect screw 5 with threaded end extending upward from the middle of the bracket 8. The sockets 6 can be electrically wired to removable pin plug 10 that can be removably connected to female socket 17 in plug plate 15. A dome shaped glass shade 3 with center opening can be held in place to the disc shaped bracket 8 by being locked to upper threaded end of bracket mounted connect screw 5 by threadably attaching decorative type nut 1 that is on top of a decorative cover ring 2, where the decorative cover ring has a larger diameter to stabilize and hold the glass shade 3 in place.

The cover 11 as shown in FIG. 1B is secured to the bath fan housing 19*by* a screw 31 in one side and two hook tabs 32 (one is shown) on another side.

The motor bracket 8 shown in FIG. 1B is attached to the bath fan housing with fasteners, such as screws and nuts, which connect through holes in hanging flange edges 8B and through matching screw holes in the side of the housing 19.

Figure 10:
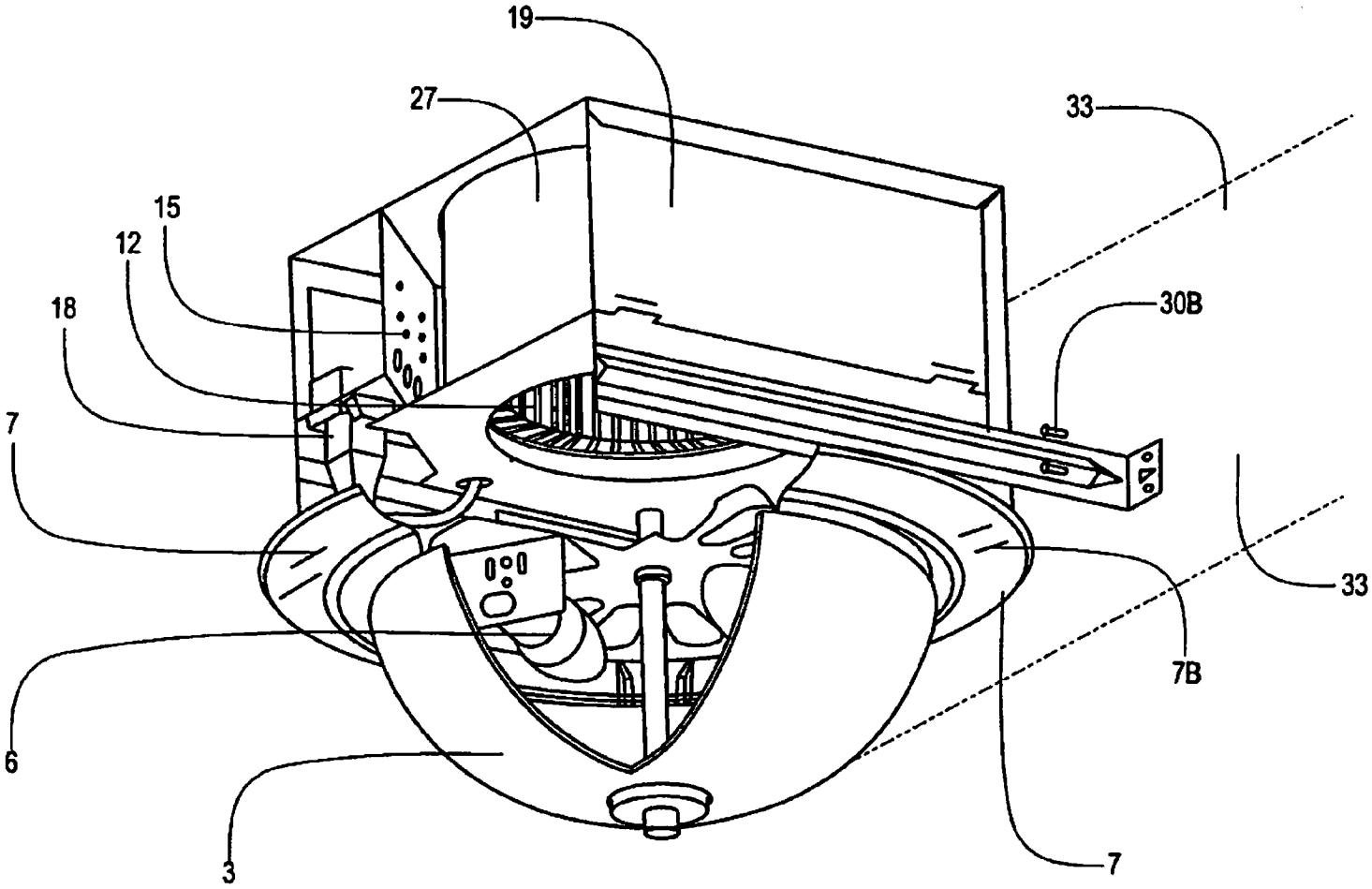
FIG. 10 shows the assembled bath fan with flush mount light of the preceding figures mounted to a joist.
Figure 11:
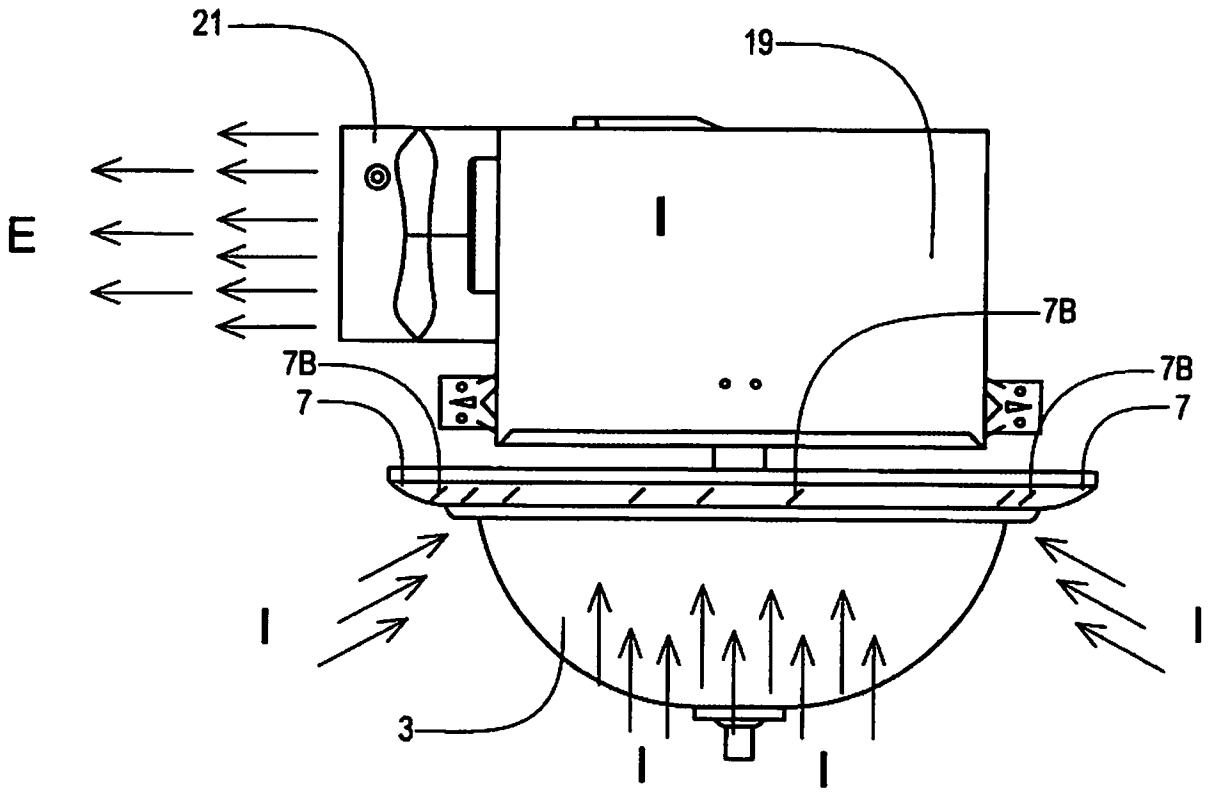
FIG. 11 shows the airflow through the outer rim of the light and into the bath fan where it the exhaust emission is exhausted sideways from the housing.

FIG. 10 shows the assembled bath fan with flush mount light of the preceding figures with one of the brackets 30B mounted to a joist 32 by conventional fasteners, such as screws. FIG. 11 shows airflow I through the outer rim 7 of light 3 and into the bath housing 19 fan where the exhaust emission E is exhausted sideways from the housing 19. Air does not pass through the light shade 3 and does not go around the bulbs 6 nor sockets 4.

As shown in FIGS. 1B, 10 and 11, the incoming air I passes through slotted openings 7B of the rim 7 and into the middle of the blower wheel 12 and out the exhaust duct 21 The air enters through the openings of the flush mount plate 7 into the blower wheel 12 and then the blower wheel 12 guides the air around the metal plate 28 towards the outlet duct 21 finally to be exhausted.

Although the invention describes mounting the bath fan in a ceiling the bath fan can be also mounted on walls, and the like, and can also be mounted in any other interior space other than a bathroom.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An exhaust fan for ceilings, comprising:

a housing with a top, sides and bottom with opening, an outlet extending sideways from the housing, the top and bottom adapted to being parallel to a ceiling;

a blower wheel with a central opening mounted inside of the housing, the blower wheel rotating in a horizontal plane parallel to the top of the housing;

a motor having an upper end and a bottom end and sides, the upper end of the motor mounted by a plurality of spaced apart brackets to the top of the housing, the motor being inside of the blower wheel and separated from the blower wheel, the motor for rotating the blower wheel, wherein each of the brackets includes:

a single upper L-shaped flange and a single lower L-shaped flange forming a C shape, each single upper L-shaped flange consisting of a single horizontal leg and a single vertical leg, each single lower L-shaped flange consisting of a single horizontal leg and a single vertical leg, the single vertical leg of the upper L-shaped flange being attached to the single vertical leg of the lower L-shaped flange, with the single horizontal leg of the upper L-shaped flange directly attached to the outer top wall of the housing, and the single horizontal leg of the lower L-shaped flange directly attached to the upper end of the motor; and a scroll having generally cylindrical sides and a side opening, an open end and an opposite closed end with a generally flat base plate forming the top of the housing, with the cylindrical sides of the scroll surrounding perimeter sides of the blower wheel, the scroll for directing air from the blower wheel through the outlet of the housing.

2. The exhaust fan of claim 1, wherein each of the brackets includes a fastener for attaching vertical legs of the upper L-shaped flange to the lower L-shaped flange.

3. The exhaust fan of claim 1, wherein the scroll consists of:

one piece having the generally cylindrical sides with the generally flat base plate, wherein the one piece reduces excess noise from air movement.

4. The exhaust fan of claim 1, further comprising:

a flush mount light attached to the bottom of the housing, wherein air enters into the open bottom of the housing and is exhausted therefrom by the motor run blower through the outlet duct extending sideways from the housing.

5. The exhaust fan of claim 4, wherein the flush mount light includes:

a dome shaped shade.

6. The exhaust fan of claim 1, further comprising:

an opening through the bottom of the motor;

a dome member fixed inside of the blower wheel;

a rod having an upper end and a bottom end, the upper end of the rod attached to inside the bottom opening of the motor, the bottom end of the rod attached to the dome member, so that the rod connects the blower wheel to the motor; and a nut generally in the center of the wheel that fastens to the rod so that when the motor is on, the motor causes the blower wheel to spin.

7. The exhaust fan of claim 1, further comprising:

a light shade having a closed end and an open base end, the light shade for supporting a light source inside of the shade between the closed end and the open base end, the light shade being outside of the housing; and a single decorative pan rim attached to the open base end of the light shade, the rim having an inner surface for flush mounting adjacent to a ceiling and an outer exposed surface, the rim having vent openings through the outer exposed surface and the inner surface, wherein air enters through the vent openings of the rim behind the light source and into the exhaust fan, and does not pass into the shade nor around the light source.

8. A method of exhausting air from a space through a ceiling mounted fan, comprising the steps of:

providing a housing having a top, sides, bottom with an opening, and a side exhaust duct extending from the housing;

providing a motor having an upper end, a bottom end and sides;

mounting the upper end of the motor by brackets to the top of the housing;

providing each of the brackets include a single upper L-shaped flange and a single lower L-shaped flange forming a C shape, each single upper L-shaped flange consisting of a single horizontal leg and a single vertical leg, each single lower L-shaped flange consisting of a single horizontal leg and a single vertical leg, the single vertical leg of the upper L-shaped flange being attached to the single vertical leg of the lower L-shaped flange, with the single horizontal leg of the upper L-shaped flange directly attached to the outer top wall of the housing, and the single horizontal leg of the lower L-shaped flange directly attached to the upper end of the motor;

mounting a blower wheel to the bottom end of the motor, with the wheel about the motor so that the wheel rotates in a horizontal plane parallel to the top;

providing a scroll having generally cylindrical sides and a side opening, an open end and an opposite closed with end with a generally flat base plate forming the top wall of the housing;

surrounding perimeter sides of the blower wheel within the generally cylindrical sides of the scroll; and mounting the housing within a ceiling, so that the top and bottom of the housing is parallel to the ceiling.

9. The method of claim 8, further comprising the step of:

mounting a light shade with an inside light source with an exterior rim having at least one opening therethrough, to the open bottom of the housing, with the rim and light shade below the ceiling;

passing incoming air through the at least one opening of the rim, behind the light source and into the middle of the blower wheel with the scroll directing air from the blower wheel out the outlet duct extending sideways from one side of the housing, so that the incoming air does not pass into the light shade nor around the light source.

10. The method of claim 9, wherein the at least one opening in the rim includes:

a plurality of slotted openings.

11. The method of claim 8, further comprising the step of:

forming the scroll with the cylindrical sides and flat base plate from a one piece plate in order to reduce excess noise from air movement.

12. The method of claim 8, wherein each of the brackets includes a fastener for attaching the vertical leg of the upper L-shaped flange to the vertical leg of the lower L-shaped flange.

13. An exhaust fan comprising:

a housing having a top, sides, an outlet and bottom with an opening;

a motor having an upper end, a bottom end and sides, the upper end of the motor mounted by brackets to the top of the housing, wherein each of the brackets includes:

a single upper L-shaped flange and a single lower L-shaped flange forming a C shape, each single upper L-shaped flange consisting of a single horizontal leg and a single vertical leg, each single lower L-shaped flange consisting of a single horizontal leg and a single vertical leg, the single vertical leg of the upper L-shaped flange being attached to the single vertical leg of the lower L-shaped flange, with the single horizontal leg of the upper L-shaped flange directly attached to the outer top wall of the housing, and the single horizontal leg of the lower L-shaped flange directly attached to the upper end of the motor;

a blower wheel with an opening mounted inside of the housing, with the motor mounted in the housing, so that a portion of the motor is inside of the blower wheel, wherein the motor runs the blower wheel to rotate in a plane parallel to the top; and a scroll having generally cylindrical sides and a side opening, an open end and an opposite closed end with a generally flat base plate forming the top of the housing, with the cylindrical sides of the scroll surrounding perimeter sides of the blower wheel, the scroll for directing air from the blower wheel through the outlet of the housing.

14. The exhaust fan of claim 13, further comprising:

a light shade outside of the housing having an interior light source mounted inside the shade, the shade attached to the bottom of the housing, and extending below the ceiling; and a single pan rim having vents therethrough with the rim attached about a open base of the shade, wherein air enters through the vents of the rim behind the light source, and into the open bottom of the exhaust fan and is exhausted therefrom by the motor run blower, wherein the air does not pass into the shade nor around the light source.

15. The exhaust fan of claim 13, further comprising:

an opening through the bottom of the motor;

a dome member fixed inside of the blower wheel;

a rod having an upper end and a bottom end, the upper end of the rod attached to inside the bottom opening of the motor, the bottom end of the rod attached to the dome member, so that the rod connects the blower wheel to the motor; and a nut generally in the center of the wheel that fastens to the rod so that when the motor is on, the motor causes the blower wheel to spin.

16. The exhaust fan of claim 13, wherein the scroll consists of:

a one piece plate forming the cylindrical sides and base plate, in order to reduce excess noise from air movement.

17. The exhaust fan of claim 13, wherein each of the brackets includes a fastener for attaching the vertical leg of the upper L-shaped flange to the vertical leg of the lower L-shaped flange.

* * * * *